US009859647B2

(12) United States Patent
Philip

(10) Patent No.: US 9,859,647 B2
(45) Date of Patent: Jan. 2, 2018

(54) TWO-PART SUBSEA BULKHEAD CONNECTOR AND METHOD FOR RAPID REPLACEMENT OR RE-PURPOSING OF SUBSEA BULKHEAD CONNECTOR

(71) Applicant: Oceaneering International, Inc., Houston, TX (US)

(72) Inventor: Mark Charles Philip, Cypress, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/963,829

(22) Filed: Dec. 9, 2015

(65) Prior Publication Data

US 2016/0164219 A1 Jun. 9, 2016

Related U.S. Application Data

(60) Provisional application No. 62/089,586, filed on Dec. 9, 2014.

(51) Int. Cl.

| | |
|---|---|
| ***H01R 13/40*** | (2006.01) |
| ***H01R 13/52*** | (2006.01) |
| ***H01R 13/523*** | (2006.01) |
| ***H01R 13/502*** | (2006.01) |
| *H01R 43/00* | (2006.01) |
| *H01R 13/74* | (2006.01) |

(52) U.S. Cl.

CPC ..... *H01R 13/5202* (2013.01); *H01R 13/502* (2013.01); *H01R 13/523* (2013.01); *H01R 13/74* (2013.01); *H01R 43/005* (2013.01)

(58) Field of Classification Search

CPC .... H01R 43/005; H01R 13/74; H01R 13/523; H01R 13/502; H01R 13/5202

USPC ..... 439/587, 556, 559, 548

See application file for complete search history.

(56) References Cited

U.S. PATENT DOCUMENTS

| | | | | | |
|---|---|---|---|---|---|
| 3,412,365 | A | * | 11/1968 | Nelson | H01R 13/523 174/152 R |
| 3,613,048 | A | * | 10/1971 | Brundza | H01R 13/523 439/275 |
| 3,753,212 | A | * | 8/1973 | Yamada | H01R 13/28 439/358 |
| 3,972,581 | A | * | 8/1976 | Oldham | H01R 13/523 439/201 |

(Continued)

*Primary Examiner* — Abdullah Riyami
*Assistant Examiner* — Nelson R Burgos-Guntin
(74) *Attorney, Agent, or Firm* — Maze IP Law, PC

(57) ABSTRACT

A two-part subsea bulkhead connector may be replaced and/or re-purposed of without draining an enclosure or disconnecting hard wiring therein, the two-part subsea bulkhead connector a first bulkhead connector, a second bulkhead connector, and a substantially water tight mechanical seal disposed intermediate the first bulkhead connector. When mated, first and second bulkhead connectors are aligned and contacts received into a corresponding contact. The first bulkhead connector is secured to the second bulkhead connector sufficiently to allow the mechanical seal to prevent water ingress. If a first contact becomes damaged or if a differing functionality set is needed, the second bulkhead connector may be removed from the first bulkhead connector and replaced.

14 Claims, 1 Drawing Sheet

(56) References Cited

U.S. PATENT DOCUMENTS

Figure 1:
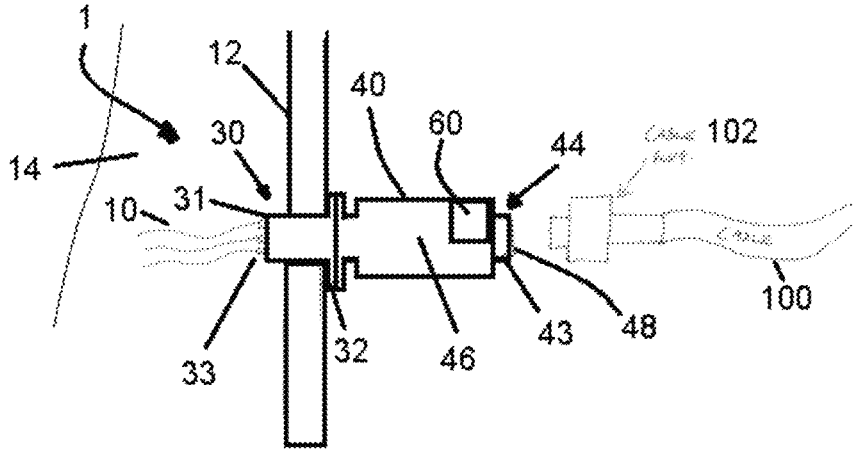

| | | | | | |
|---|---|---|---|---|---|
| 3,977,750 | A * | 8/1976 | Glover | H01R 13/53 | 439/320 |
| 4,193,655 | A * | 3/1980 | Herrmann, Jr. | H01R 13/502 | 439/166 |
| 4,909,751 | A * | 3/1990 | Marolda, Jr. | H01R 13/523 | 439/273 |
| 5,213,520 | A * | 5/1993 | Casey | H01R 13/748 | 174/77 R |
| 5,432,879 | A * | 7/1995 | Lee | G02B 6/3869 | 385/56 |
| 5,532,436 | A * | 7/1996 | Moyers | H02G 3/22 | 174/138 G |
| 5,769,661 | A * | 6/1998 | Nealis | H01R 24/52 | 439/546 |
| 5,890,922 | A * | 4/1999 | Buchter | H01R 13/504 | 439/284 |
| 5,902,150 | A * | 5/1999 | Sigl | B23K 9/323 | 439/587 |
| 6,435,891 | B1 * | 8/2002 | Beck, Jr. | H01R 13/6315 | 439/248 |
| 6,517,380 | B1 * | 2/2003 | Deutsch | H01R 13/746 | 439/598 |
| 6,962,445 | B2 * | 11/2005 | Zimmel | G02B 6/3825 | 385/55 |
| 7,481,584 | B2 * | 1/2009 | Cairns | H01R 13/5219 | 385/60 |
| 8,758,049 | B2 * | 6/2014 | Mochizuki | H01R 13/527 | 439/559 |
| 9,130,305 | B2 * | 9/2015 | Ramos | H01R 13/5221 | |
| 9,368,903 | B1 * | 6/2016 | Keep | H01R 13/5205 | |
| 9,368,907 | B2 * | 6/2016 | Becker | H01R 13/5221 | |

* cited by examiner

TWO-PART SUBSEA BULKHEAD CONNECTOR AND METHOD FOR RAPID REPLACEMENT OR RE-PURPOSING OF SUBSEA BULKHEAD CONNECTOR

RELATION TO PRIOR APPLICATIONS

This application claims the benefit of, and priority through, U.S. Provisional Application 62/016,931, titled "Two-Part Subsea Bulkhead Connector And Method For Rapid Replacement Or Re-Purposing Of Subsea Bulkhead Connector," filed Dec. 9, 2014.

BACKGROUND

A subsea bulkhead connector provides a means of connecting a subsea cable to electrical/electronic equipment that reside inside a sealed enclosure. The enclosure can either be one-atmosphere, or oil-filled and pressure balanced. Existing subsea bulkhead connectors are typically one-piece and are affixed to an opening in the enclosure, thereby creating an electrical pass-thru for power and signals. The bulkhead connector's inboard end has contacts that are typically hard-wired (e.g. soldered) to the electrical/electronic equipment that resides within the enclosure. The bulkhead connector's outboard end has contacts that connect with those inside a corresponding mating plug attached to the subsea cable.

The most common type of failure associated with existing subsea bulkhead connectors is bent or broken contacts on the outermost portion. The two most common causes of this are mishandling during mating or un-mating of the cable connector and/or corrosion induced by water ingress.

When existing subsea bulkhead connectors become damaged, the entire part must be replaced. This process typically involves de-soldering electrical conductors from the innermost end, before re-soldering them to the replacement connector. This is a time-consuming process, especially when the enclosure is oil-filled, as the oil must first be drained before the damaged connector can be removed.

The process of replacing an existing subsea bulkhead connector also has certain risks that can lead to subsequent equipment failure, by way of example including miswiring a replacement connector, damaging the seals of the replacement connector during re-assembly, and/or incorrect installation. The result may be loss of water-tight seal and subsequent flooding of the enclosure when it returns subsea. With oil-filled enclosures, failure to adequately purge all air when re-filling can also result in water ingress when the enclosure returns subsea.

FIGURES

Various figures are included herein which illustrate aspects of embodiments of the disclosed inventions.

Figure 2:
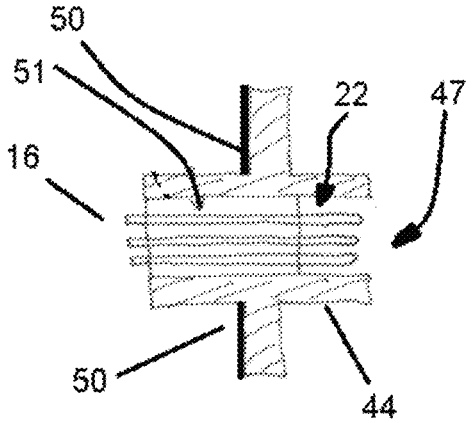
Figure 3:
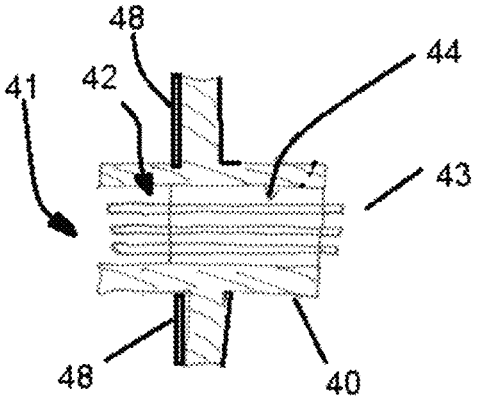

FIG. 1 is a block schematic cross-sectional diagram of an exemplary two-part bulkhead connector; and FIG. 2 is a block schematic cross-sectional diagram of a portion of an exemplary first member of a two-part bulkhead connector; and FIG. 3 is a block schematic cross-sectional diagram of a portion of an exemplary second member of a two-part bulkhead connector

DESCRIPTION OF EXEMPLARY EMBODIMENTS

Referring to FIG. 1, in a first embodiment, connector 1 comprises first bulkhead connector 30, configured to be connected to bulkhead 12; second bulkhead connector 40 cooperatively and selectively matable with first bulkhead connector 30 at mating end 41; and substantially water tight mechanical seal 48 (FIG. 3) disposed intermediate first bulkhead connector 30 and second bulkhead connector 40. Seal 50 (FIG. 2) may also be present and disposed intermediate first bulkhead connector 30 and bulkhead 12.

First bulkhead connector 30 is made of any appropriate material, e.g. metal suitable for subsea use, and typically further comprises inboard end 31 comprising one or more contacts 16 (FIG. 2), which are matable with wiring loom 10 such as inside bulkhead enclosure 14, and outboard end 32 comprising one or more first contacts 22. Contact 16 typically comprises one or more solderable connections. Additionally, sealer 51 may be present and dispersed within first bulkhead connector 30, and, if present, typically fills the interior of first bulkhead connector 30.

Second bulkhead connector 40 is also made of any appropriate material, e.g. metal suitable for subsea use, and further comprises one or more second contacts 42 (FIG. 2) cooperatively matable with the first bulkhead connector contact 22. In an embodiment, each first contact 22 typically comprises one or more first male contacts 22 and second contact 42 typically comprises a set of first female connectors 42 corresponding and configured to cooperatively mate with a corresponding first male contact 22. In an alternative embodiment, first contact 22 comprises one or more first female contacts 22 and second contact 42 comprises a corresponding set of first male connectors 42 configured to cooperatively mate with a corresponding set of first female contacts 22.

In certain embodiments, second bulkhead connector 40 comprises interior pressurized chamber 46 (FIG. 1) which may be configured to contain pressure at around one atmosphere.

Referring additionally to FIG. 2, second bulkhead connector 40 typically comprises outermost end 43 which, in an embodiment, comprises one or more subsea cable interfaces 44 which may comprise standard contact and locking features for mating with subsea cable 100. Subsea cable interface 44 may comprise one or more cable contacts 47, cable locks 45, sacrificial components 49, or the like, or a combination thereof.

In the operation of exemplary embodiments, referring generally to FIG. 1, subsea bulkhead connector 30 may be replaced rapidly and/or re-purposed without draining an enclosure or disconnecting hard wiring therein by connecting first bulkhead connector 30 to bulkhead 12 using any suitable fasteners, where first bulkhead connector 30 is a described above. Second bulkhead connector 40, which is as described above, is selectively mated with first bulkhead connector 30 with substantially water tight mechanical seal 48 (FIG. 3), configured to prevent water ingress, typically disposed intermediate first bulkhead connector 30 and second bulkhead connector 40.

In an embodiment, second bulkhead connector 40 is mated to first bulkhead connector 30 by aligning one or more first contacts 22 (FIG. 2) with a corresponding set of second contacts 42 (FIG. 3) and receiving either first contact 22 into second contact 42 or second contact 42 into first contact 22. Once first contacts 22 and second contacts 42 are cooperatively received, first bulkhead connector 30 is secured to second bulkhead connector 40 sufficiently to allow substantially water tight mechanical seal 48 (FIG. 3) to prevent water ingress, e.g. mechanically using one or more appropriate mechanical fasteners.

As described above, in alternative embodiments second bulkhead connector 40 incorporates one-atmosphere interior chamber 46 which may comprise a set of required conversion electronics 60.

In embodiments, first contact 22 may be monitored on outboard end 32 of first bulkhead connector 30 such as for damage. If one or more first contacts 22 becomes damaged, second bulkhead connector 40 may be removed from first bulkhead connector 30 and first contact 22 and/or its mated second contact 42 examined to determine which is needing to be replaced. If one needs to be replaced, the contact which needs to be replaced may then be replaced. For example, if there is some form of power or media conversion required outside of bulkhead enclosure 14, only second bulkhead connector 40 may need to be replaced.

In some embodiments, second bulkhead connector 40 incorporates a small one-atmosphere void which may house required electronics, e.g. conversion electronics. Like the repair process described above, removing or replacing second bulkhead connector 40 can be achieved without draining the enclosure or disconnecting any of the hard wiring therein.

In a further embodiment, if different functionality for first bulkhead connector 30 or second bulkhead connector 40 is required, second bulkhead connector 40 is disconnected from first bulkhead connector 30 and replaced with a bulkhead connector that comprises the required different functionality.

The foregoing disclosure and description of the inventions are illustrative and explanatory. Various changes in the size, shape, and materials, as well as in the details of the illustrative construction and/or an illustrative method may be made without departing from the spirit of the invention.

I claim:

1. A connector, comprising:

a. a first bulkhead connector configured to be connected to a bulkhead, the first bulkhead connector further comprising:
   i. an inboard end comprising an electrically conductive inboard contact matable with a wiring loom inside a bulkhead enclosure; and
   ii. an outboard end comprising a first conductive contact operatively in communication with the conductive inboard contact;

b. a second bulkhead connector cooperatively and selectively matable with the first bulkhead connector subsea, the second bulkhead connector further comprising a second electrically conductive contact cooperatively and conductively matable with the first bulkhead connector conductive inboard contact; and c. a substantially water tight mechanical seal disposed intermediate the first bulkhead connector and the second bulkhead connector.

2. The connector of claim 1, wherein:

a. the electrically conductive inboard contact comprises a first male contact; and b. the second electrically conductive contact comprises a first female connector configured to cooperatively mate with the first male contact.

3. The connector of claim 1, wherein:

a. the electrically conductive inboard comprises a first female contact; and b. the second electrically conductive contact comprises a first male connector configured to cooperatively mate with the first female contact.

4. The connector of claim 1, wherein the second bulkhead connector comprises an outermost end comprising a subsea cable interface.

5. The connector of claim 4, wherein the subsea cable interface comprises a cable contact.

6. The connector of claim 1, wherein the subsea cable interface comprises a cable lock.

7. The connector of claim 1, wherein the second bulkhead connector comprises a sacrificial component.

8. The connector of claim 1, wherein the second bulkhead connector comprises an interior pressurized chamber.

9. The connector of claim 8, wherein the interior pressurized chamber is configured to contain pressure at around one atmosphere.

10. The connector of claim 1, wherein the contact comprises a solderable connection.

11. A method of rapid replacement or re-purposing a subsea bulkhead connector subsea without draining an enclosure or disconnecting hard wiring therein, comprising:

a. connecting a first bulkhead connector to a bulkhead, the first bulkhead connector further comprising:
   i. an inboard end comprising an electrically conductive inboard contact matable with a wiring loom inside a bulkhead enclosure; and
   ii. an outboard end comprising a first conductive contact operatively in communication with the conductive inboard contact;

b. disposing a second bulkhead connector cooperatively and selectively matable with the first bulkhead connector subsea, the second bulkhead connector further comprising a second electrically conductive contact cooperatively and conductively matable with the first bulkhead connector conductive inboard contact;

c. mating the second bulkhead connector to the first bulkhead connector subsea, the mating comprising:
   i. aligning the first contact with the second contact;
   ii. receiving either the first contact into the second contact or the second contact into the first contact;

d. securing the first bulkhead connector to the second bulkhead connector sufficiently to allow the mechanical seal to prevent water ingress;

e. monitoring the first contact on the outboard end of the first bulkhead connector for damage;

f. if the first contact becomes damaged,
   i. removing the second bulkhead connector from the first bulkhead connector;
   ii. determining which of the first contact or its mated second contact needs to be replaced; and
   iii. replacing the contact which needs to be replaced.

12. The method of rapid replacement or re-purposing of subsea bulkhead connector without draining an enclosure or disconnecting hard wiring therein of claim 11, further comprising:

a. determining that different functionality for the first bulkhead connector or second bulkhead connector is required;

b. disconnecting the second bulkhead connector from the first bulkhead connector; and c. replacing the second bulkhead connector with a bulkhead connector that comprises the different functionality.

13. The method of rapid replacement or re-purposing of subsea bulkhead connector without draining an enclosure or disconnecting hard wiring therein of claim 11, further comprising using a second bulkhead connector that incorporates one-atmosphere interior chamber.

14. The method of rapid replacement or re-purposing of subsea bulkhead connector without draining an enclosure or disconnecting hard wiring therein of claim 13, wherein the one-atmosphere interior chamber comprises a set of required conversion electronics.

* * * * *